United States Patent [19]

Janusch

[11] Patent Number: 4,674,195

[45] Date of Patent: Jun. 23, 1987

[54] PROCESS FOR DEHYDRATING PEAT

[75] Inventor: Alois Janusch, Leoben, Austria

[73] Assignee: Voest-Alpine Aktiengesellschaft, Linz, Austria

[21] Appl. No.: 670,644

[22] Filed: Nov. 13, 1984

[30] Foreign Application Priority Data

Nov. 15, 1983 [AT] Austria ..... 4017/83

[51] Int. Cl.[4] ..... F26B 7/00

[52] U.S. Cl. ..... 34/8; 34/15; 34/58

[58] Field of Search ..... 34/8, 15, 35, 58, 86

[56] References Cited

U.S. PATENT DOCUMENTS

| | | | |
|---|---|---|---|
| 2,536,676 | 1/1951 | Brown | 34/58 |
| 3,007,254 | 11/1961 | Schuster | 34/86 |
| 4,472,885 | 9/1984 | Nakabayashi et al. | 34/15 |
| 4,514,910 | 5/1985 | Elmore et al. | 34/15 |
| 4,536,969 | 8/1985 | Sherman | 34/35 |

FOREIGN PATENT DOCUMENTS

| | | |
|---|---|---|
| 366090 | 3/1982 | Austria . |
| 366405 | 4/1982 | Austria . |
| 369423 | 12/1982 | Austria . |

*Primary Examiner*—Albert J. Makay
*Assistant Examiner*—David W. Westphal
*Attorney, Agent, or Firm*—Cushman, Darby & Cushman

[57] ABSTRACT

For dehydrating peat, centrifuges (5) being pressurized by saturated steam having a pressure of 2 to 35 bar are used, the heat of the discharged condensate as well as of the removed water being recovered.

9 Claims, 1 Drawing Figure

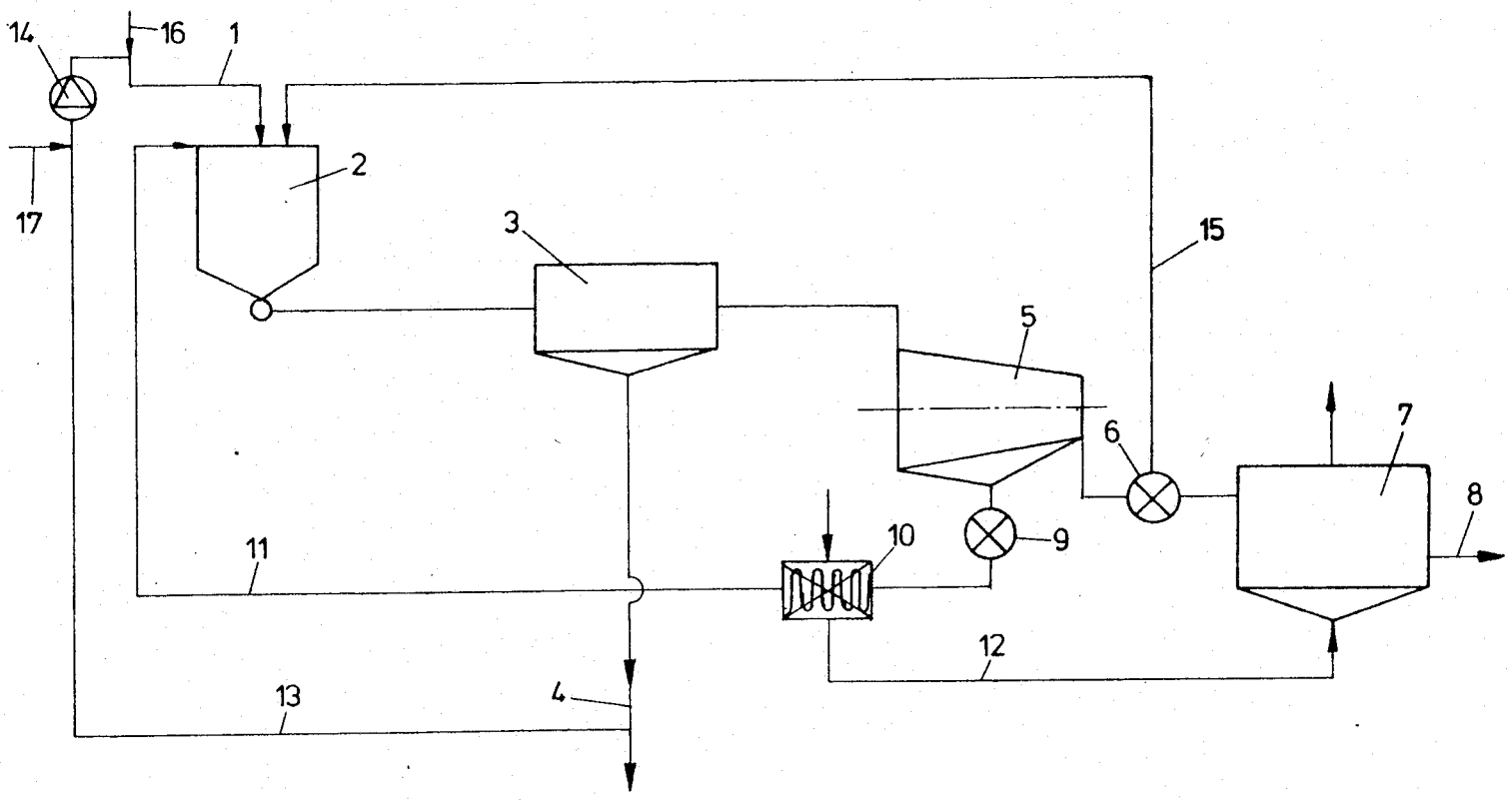
1
2
3
4
5
6
7
8
9
10
11
12
13
14
15
16
17

PROCESS FOR DEHYDRATING PEAT

BACKGROUND OF THE INVENTION

1. Field of the Invention

The invention relates to a process for the dehydration of peat. In peat extraction and processing reduction of the high water content of the peat is an essential prerequisite for processing. For the dehydration of peat almost exclusively natural air-drying has been used so far which is time-consuming and expensive and dependent on the weather. When being used as fuel, had to be added to the peat only partially dried in order to make combustion possible.

The invention is designed to dry peat in a way that the peat is dried by machine so as to facilitate combustion without additional firing or any kind of processing, for example, with manure, into briquettes for burning, into peat coke and the like. In order to solve this problem the invention consists essentially in the peat being supplied to a centrifuge capable of being closed so that it is pressure tight and being pressurized by saturated steam at a pressure of 2 to 35 bar, preferably 5 to 20 bar, while being centrifuged.

2. Description of the Related Art

Using saturated steam for drying organic substances is already known in connection with coals, reference being made in particular to the process according to Fleißner. The adsorption of water by coal differs considerably from the adsorption of water by peat and thus the technology developed for coal does not seem to be immediately applicable to peat. In connection with drying coals it has been further proposed by the Austrian Pat. Nos. 366 090, 366 405 and the 369 423 to use centrifuges in a successive drying step which centrifuges were pressurized by steam. The drying procedure of brown coals in a centrifuge by means of superheated steam subsequent to Fleißner-drying, which procedure is known from the Austrian Pat. No. 366 090, is not applicable to the drying of peat in the first step in view of the use of superheated steam, as peat has other physico-chemical properties than brown coal. In tests of comparison it has been found that by combining the drying procedure for brown coals using centrifuges, which procedure for successive drying steps is known from the Austrian Pat. Nos. 366 405 and 369 423, with saturated steam an unexpected dehydration effect which exceeds by far the summation effect in drying peat in the first drying step was achieved. While in treating black peat and white peat with saturated steam in a pressure range of 2 to 10 bar reduction of the water content in the range of 30 to 35% was achievable, reduction of the water content of more than 80% could be achieved by using centrifugal force simultaneously. The effect of dehydration essentially being increased by using saturated steam at the same time is presumably due to several factors favourable to dehydration. For one thing the temperature of treatment of the peat is increased by using saturated steam in the centrifugal field on account of the immediate discharge of the condensate and of the water liberated from the peat by which desorption of the water from the peat is favoured. At the same time the viscosity of the water being reduced, the separating effect is positively influenced in the system peat-water. Finally the compaction and/or compression of the peak cake occurring on account of the centrifugal forces causes additional water contained in the peat to be squeezed out.

SUMMARY OF THE INVENTION

The dehydration effect could be achieved herein at pressures of saturated steam of about 10 bar. Surprisingly not only white peat which can be dehydrated relatively easily, but also black peat which is relatively difficult to dehydrate could be dehydrated efficiently without more difficulties by the process according to the invention. The product obtained could be burned without additional firing and without addition of fuel. By a treatment with saturated steam at higher temperatures coalification of the peat by degradation of the functional oxygen groups as well as enrichment of the carbon is achieved, by which the calorific value of the water-ashless peat substance is noticeably increased.

Within the scope of the process according to the invention it is a particular advantage that the time of treatment in the centrifuge can be chosen freely, and thus the time of treatment in the centrifuge or centrifuges, respectively, is conveniently adapted to the peat quality and/or to the desired content of residual water.

In order to improve heat balance the heat of the condensate discharged from the centrifuge or the water liberated from the peat, respectively, can be utilized for preheating the peat before being charged into the centrifuge. On this occasion the waste water can be used also as a transport medium, for which purpose a suspension of the peat in hot water is prepared and charged to a preheating stage.

In a simple way one can arrange the preheated peat to be mechanically predehydrated to a large extent.

The peat discharged from the centrifuge can be conveniently subjected to subsequent drying, wherein in order to improve the energy balance one can again manage the heat of the condensate discharged from the centrifuge or the water liberated from the peat, respectively, before being used for preheating the peat to be used for heating the air for subsequent drying of the peat discharged from the centrifuge.

For further adaptation to different peat qualities within the scope of the process according to the invention one can manage the successive centrifuges to be subjected to different pressures of saturated steam. Also hereby extensive adaptation to the desired degree of coking and to the dehydration behaviour of different peat qualities is ensured.

BRIEF DESCRIPTION OF THE DRAWING

The invention is subsequently explained in detail with reference to an apparatus for realizing the process according to the invention schematically represented in the drawing.

DETAILED DESCRIPTION OF THE PREFERRED EMBODIMENTS

The results of tests of comparison are summed up in tables. Herein the dehydration of black peat, i. e. which is relatively hard to dehydrate, is represented in Table 1, wherein the tests 1, 3, 5, 7, and 9 were effected in a test autoclave without application of centrifugal forces only at the indicated pressure of saturated steam. As opposed to that, the tests 2, 4, 6, 8, and 10 of Table 1 were effected under simultaneous application of a centrifugal force, a cycle time depending on the test conditions of five minutes for the preheating stage, 15 minutes for the centrifugal treatment and five minutes for the removal of stress as well as a number of revolutions of the centrifuge of 750 per minute in the first stage, 2500 per minute in the second stage and 750 per minute in the third stage being chosen. The water content of the charged sample was herein 88.7% by weight, or 785 g $H_2O$ per 100 g dry matter, respectively.

TABLE 1

| Test No. | Pressure of saturated steam [bar] | Water content of dehydrated peat sample [% by weight] | Sp. Water content of dehydrated peat sample [g $H_2O$/100 g dry matter] | Water removed [%] |
|---|---|---|---|---|
| 1 | 5 | 84.4 | 541.0 | 31.1 |
| 2 | 5 | 67.8 | 210.6 | 73.2 |
| 3 | 10 | 83.6 | 509.8 | 35.1 |
| 4 | 10 | 58.1 | 138.7 | 82.3 |
| 5 | 20 | 79.4 | 385.4 | 50.9 |
| 6 | 20 | 50.3 | 101.2 | 87.1 |
| 7 | 30 | 73.5 | 277.4 | 64.7 |
| 8 | 30 | 39.8 | 66.1 | 91.6 |
| 9 | 35 | 73.3 | 274.5 | 65.0 |
| 10 | 35 | 37.6 | 60.3 | 92.3 |

Peat of equal composition treated by way of comparison at 20° C. in a centrifuge without applying saturated steam showed a water content of 85.0% by weight or 566.7 g $H_2O$ per 100 g dry matter, respectively.

In Table 2 analogous results of another black peat sample are represented, the tests marked with odd numbers designating the dehydration tests in an autoclave. The tests marked with even numbers illustrate the results obtained by simultaneous application of centrifugal forces corresponding to the indications given for Table 1.

As peat samples employed in Table 1 black peat was used which is relatively easy to dehydrate and the water content of which was 88.5% by weight or 640.7 g $H_2O$ per 100 g dry matter. A test of comparison in a centrifuge at a temperature of 20° C. without application of saturated steam showed a drying result of 69.8% by weight or 231.1 g $H_2O$ per 100 g dry matter, respectively.

TABLE 2

| Test No. | Pressure of saturated steam bar | Water content of dehydrated peat sample % by weight | Sp. water content of dehydrated peat sample g $H_2O$/100 g dry matter | Water removed % |
|---|---|---|---|---|
| 1 | 5 | 84,5 | 545,2 | 14,9 |
| 2 | 5 | 66,3 | 196,7 | 69,3 |
| 3 | 10 | 86,1 | 619,4 | 3,3 |
| 4 | 10 | 62,3 | 165,3 | 74,2 |
| 5 | 20 | 80,1 | 402,5 | 37,2 |
| 6 | 20 | 55,3 | 123,7 | 80,7 |
| 7 | 30 | 78,5 | 365,1 | 43,0 |
| 8 | 30 | 46,0 | 85,2 | 86,7 |
| 9 | 35 | — | — | — |
| 10 | 35 | 41,2 | 70,0 | 89,1 |

Finally in Table 3 the characteristics of further peat samples employed are represented, which were dehydrated at a pressure of saturated steam of 10 and 35 bar in a centrifuge. In this Table 3, black peat L means a peat easy to dehydrate and black peat S means a peat difficult to dehydrate.

TABLE 3

| analytical characteristic | dimension unit | black peat L | black peat L 10 bar test. 4/ Tab. 2 | black peat L 35 bar test. 10/ Tab. 2 |
|---|---|---|---|---|
| water | (% by weight) | 85,54 | 60,32 | 38,26 |
| ash (raw) | (% by weight) | 0,43 | 1,42 | 2,81 |
| ash (wf) | (% by weight) | 3,00 | 3,58 | 4,56 |
| liquid components (raw) | (% by weight) | 9,85 | 26,69 | 35,77 |
| liquid components (waf) | (% by weight) | 70,22 | 69,75 | 60,70 |
| $C_{fix}$ (raw) | (% by weight) | 4,18 | 11,57 | 23,16 |
| $C_{fix}$ (waf) | (% by weight) | 29,78 | 30,25 | 39,30 |
| $C_{fix}$ (waf) | (% by weight) | 57,59 | 57,90 | 65,97 |
| H (waf) | (% by weight) | 5,89 | 5,96 | 5,97 |
| N (waf) | (% by weight) | 1,55 | 1,32 | 1,56 |
| $S_G$ (wf) | (% by weight) | 0,35 | 0,28 | 0,28 |
| O (waf) | (% by weight) | 34,71 | 34,63 | 26,35 |
| calorific value (raw) | (MJ/kg) | 0,98 | 7,02 | 14,28 |
| calorific value (waf) | (MJ/kg) | 21,87 | 22,18 | 25,81 |
| water | (% by weight) | 88,74 | 55,93 | 37,78 |
| ash (raw) | (% by weight) | 0,59 | 2,41 | 4,65 |
| ash (wf) | (% by weight) | 5,23 | 5,47 | 7,47 |
| liquid components (raw) | (% by weight) | 7,16 | 27,78 | 33,17 |
| liquid components (waf) | (% by weight) | 67,08 | 66,69 | 57,61 |
| $C_{fix}$ (raw) | (% by weight) | 3,51 | 13,88 | 24,40 |
| $C_{fix}$ (waf) | (% by weight) | 32,92 | 33,31 | 42,39 |
| C (waf) | (% by weight) | 62,28 | 63,72 | 67,81 |
| H (waf) | (% by weight) | 5,76 | 5,48 | 5,85 |
| N (waf) | (% by weight) | 2,92 | 3,25 | 2,60 |
| $S_G$ (wf) | (% by weight) | 0,27 | 0,29 | 0,26 |
| O (waf) | (% by weight) | 28,95 | 27,41 | 23,68 |
| colorific value (raw) | (MJ/kg) | 0,30 | 8,59 | 14,29 |
| colorific value (waf) | (MJ/kg) | 23,07 | 23,89 | 26,43 |

In Table 4 the results of a study are summed up in which the cycle time in the test autoclave was varied. From this Table 4 emerges the fact that the best results were achieved by an increase of pressure in the second stage and by corresponding extension of the duration of this second stage.

TABLE 4

| test No. | pressure of saturated steam (bar) | cycle time (min) | water content of the treated peat sample (% by weight) peat L | peat S |
|---|---|---|---|---|
| 1 | 10 | 5/15/5 | 86,1 | 83,6 |
| 2 | 10 | 20/30/20 | 82,8 | 78,2 |
| 3 | 10 | 40/60/40 | 81,0 | 77,2 |
| 4 | 30 | 5/15/5 | 78,5 | 73,5 |
| 5 | 30 | 20/30/30 | 77,6 | 69,3 |
| 6 | 30 | 40/60/40 | 75,4 | 66,9 |

Finally tests with white peat were effected, these tests being realized at a number of revolutions of the centrifuge of 750 per minute, in the second stage 2500 per minute and in the third stage of 750 per minute in the range of pressure of saturated steam of 5 to 10 bar. The results of these studies are summed up in Table 5, also herein a cycle time of 5 minutes in the first stage, 15 minutes in the second stage and 5 minutes in the third stage being observed. Also in Table 5 the odd-numbered tests were conducted in the test autoclave, whereas the even-numbered tests were conducted in the centrifuge with simultaneous application of saturated steam of the indicated pressure. The water content of the charged sample was in this case 89.1% by weight or 817.4 g $H_2O$ per 100 g dry matter, respectively.

In the drawing an apparatus for realizing the process according to the invention is represented schematically. The raw peat passes into a vessel 2 via a charging line 1 for being preheated and from hence passes into a mechanical preliminary dehydration device 3. For preliminary dehydration a screen press or chamber filter press or a centrifuge can be used herein. The waste water of the preliminary dehydration is discharged via a passage 4 and has a higher level of temperature owing to preliminary heating. The predehydrated peat is then fed to one or several centrifuges 5, this centrifuge being pressurized by saturated steam. After being centrifuged the peat passes into an additional drying device 7 via a lock 6. The dried peat is directed to further utilization via a discharge device 8.

The waste water of mechanical dehydration which has been discharged via passage 4 can be purified and be passed to the outfall as usual.

The condensate and/or the hot water removed from the peat as well as the lock-out steam are supplied to a heat exchanger 10 via a lock 9 and returned via a passage 11 for being preheated. The heat exchanger 10 herein serves for the preheating of air which is supplied to the additional drying device 7 via a passage 12. Application of additional drying has herein the advantage of a more favourable heat balance being given to the whole process.

The heated waste water discharged via the passage 4 of the mechanical predehydration device can be returned at least in part to the peat charging line 1 via a passage 13, for this purpose a pump 14 being provided. This waste water can be blended with the peat for preparing a suspension, wherein the hot water can be used as a transport medium for the peat. Thus the waste water can be circulated to a large extent and the required expenditure for the purification of the waste water can be minimized.

In the course of the procedure the steam formed in the lock 6 can also be returned to the preheating vessel 2 via a passage 15.

The peat can be supplied to inlets 16 or 17, according to whether a suspension in the hot waste water returned and circulated is desired or the peat is supplied without being suspended in water.

TABLE 5

| test No. | pressure of saturated steam (bar) | water content of the dehydrated peat sample (% by weight) | sp. water content of the dehydrated peat sample (g $H_2O$/100 g dry matter) | water removed (%) |
|---|---|---|---|---|
| 1 | 5 | 89,0 | 809,1 | 1,0 |
| 2 | 5 | 65,0 | 185,7 | 77,3 |
| 3 | 10 | 88,8 | 792,9 | 3,0 |
| 4 | 10 | 60,5 | 153,2 | 81,3 |
| 5 | 20 | 87,4 | 693,7 | 15,1 |
| 6 | 20 | 61,6 | 160,4 | 80,4 |
| 7 | 35 | 86,2 | 624,6 | 23,6 |

TABLE 5-continued

| test No. | pressure of saturated steam (bar) | water content of the dehydrated peat sample (% by weight) | sp. water content of the dehydrated peat sample (g $H_2O$/100 g dry matter) | water removed (%) |
|---|---|---|---|---|
| 8 | 35 | 59,1 | 144,5 | 83,3 |

The quality characteristics of such white peat samples as well as of the dry sample prepared in the centrifuge at a pressure of saturated steam of 35 bar are summed up in Table 6.

TABLE 6

| analytical characteristic | dimension unit | sample charged | dry sample 35 bar test 8/Tab. 2 |
|---|---|---|---|
| water | (% by weight) | 89,13 | 59,16 |
| ash (raw) | (% by weight) | 0,12 | 0,61 |
| ash (wf) | (% by weight) | 1,09 | 1,50 |
| liquid components (waf) | (% by weight) | 75,51 | 60,99 |
| $C_{fix}$ (waf) | (% by weight) | 24,49 | 39,01 |
| C | | 54,55 | 63,04 |
| H | | 5,51 | 5,66 |
| N (waf) | (% by weight) | 1,49 | 1,11 |
| O | | 38,28 | 30,00 |
| $S_G$ (wf) | (% by weight) | 0,24 | 0,23 |
| calorific value (waf) | (MJ/kg) | 19,33 | 23,96 |

What is claimed is:

1. A process for dehydrating peat comprising subjecting peat which has not been previously treated with steam to centrifugal force in at least one centrifuge which can be rendered pressure tight and simultaneously pressurizing the peat during centrifuging with saturated steam having a pressure of 2 to 35 bar to thereby remove water from the peat, and continuously discharging from the centrifuge water removed from the peat and water formed by condensation.

2. Process according to claim 1, characterized in that the time of treatment in the centrifuge is adapted to the quality of the peat.

3. Process according to claim 2 characterized in that water from the centrifuge is utilized for preheating the peat before being supplied to the centrifuge.

4. Process according to claim 3 characterized in that the preheated peat is mechanically dehydrated to a large extent before being supplied to the centrifuge.

5. Process according to claim 4, characterized in that water from the centrifuge is used for heating air for additional drying of the peat discharged from the centrifuge before being utilized for preheating the peat.

6. Process according to claim 1, characterized in that successive centrifuges are used and that the successive centrifuges are pressurized by different pressures of saturated steam.

7. Process as in claim 1 wherein the saturated steam pressure is 5 to 20 bar.

8. Process as in claim 1 wherein the treatment time in the centrifuge is adapted to the desired content of residual water in the peat.

9. A process as in claim 1 wherein raw peat is subjected to mechanical dehydration in the absence of steam and is then passed to said at least one centrifuge for centrifuging in the presence of saturated steam and is thereafter subjected to further drying in the absence of steam.

* * * * *